United States Patent [19]

Down

[11] Patent Number: 4,887,640

[45] Date of Patent: Dec. 19, 1989

[54] FLUID INJECTION SYSTEM

[75] Inventor: Raymond L. Down, Doubleview, Australia

[73] Assignee: Fluid Technology (Aust) Limited, Perth, Australia

[21] Appl. No.: 40,366

[22] Filed: Apr. 17, 1987

[30] Foreign Application Priority Data

Apr. 18, 1986 [AU] Australia ..... PH5527

[51] Int. Cl.[4] ..... E03B 7/07

[52] U.S. Cl. ..... 137/564.5; 137/205.5

[58] Field of Search ..... 137/564.5, 205.5

[56] References Cited

U.S. PATENT DOCUMENTS

| | | | |
|---|---|---|---|
| 2,563,211 | 8/1951 | Cassesse | 137/564.5 |
| 2,618,510 | 11/1952 | Mills | 137/564.8 |
| 2,865,388 | 12/1958 | Sternbergh | 137/564.5 |
| 3,166,096 | 1/1965 | Lang | 137/564.5 |
| 3,556,141 | 1/1971 | Hind | 137/564.5 |
| 4,240,465 | 12/1980 | Rader | 137/564.5 |

*Primary Examiner*—A. Michael Chambers

[57] ABSTRACT

The present invention relates to a fluid injection system comprising a tubular member (12) arranged to form part of a fluid line through which, in use, fluid flows under pressure, a venturi (14) contained within the tubular member (12), first and second volumes arranged to contain first and second fluids respectively, said first and second volumes being separated by a pressure responsive means such as a bladder (30), the tubular member (12) on a high pressure side of the venturi (14) being in fluid communication with said first volume, and a metering line (40) extending from the tubular member on a low pressure side of the venturi and being in fluid communication with said second volume, the arrangement being such that, in use a pressure differential is created across the venturi (14) so that the first volume is increased by fluid passing from the fluid line (12) into the first volume and by movement of the pressure responsive means, the second volume is correspondingly decreased by fluid passing therefrom through the conduit into the fluid flowing through the fluid line, wherein bypass conduit means (50) is provided between the high pressure side of the venturi and the line (12) on the low pressure side of the venturi (14) so as to provide an alternate flow of fluid in the line and modify through volumetric displacement the rate of flow of the second fluid.

10 Claims, 10 Drawing Sheets

FLUID INJECTION SYSTEM

The present invention relates to a fluid injection system for injecting a first fluid into a body of a second fluid.

In accordance with one aspect of the present invention there is provided a fluid injection system comprising a tubular member arranged to form part of a fluid line through which, in use, fluid flows under pressure, a venturi contained within the tubular member, means defining first and second volumes arranged to contain first and second fluids respectively, said first and second volumes being separated by a pressure responsive means, the tubular member on a high pressure side of the venturi being in fluid communication by means of a conduit with said means defining said first volume, and a line extending from the tubular member on a low pressure side of the venturi and being in fluid communication with said means defining said second volume, the arrangement being such that, in use a pressure differential is created across the venturi so that the first volume is increased by fluid passing from the fluid line into the first volume and by movement of the pressure responsive means, the second volume is correspondingly decreased by fluid passing therefrom through the conduit into the fluid flowing through the fluid line, wherein bypass conduit means is provided between the high pressure side of the venturi and the line on the low pressure side of the venturi so as to provide an alternate flow of fluid in the line and modify through volumetric displacement the rate of flow of the second fluid. In accordance with another aspect of the present invention there is provided a method of injecting a first fluid with a second fluid, which comprises forming a first volume containing the first fluid and a second volume containing the second fluid and separating the volumes by pressure responsive means, passing a stream of fluid through a venturi so as to create a pressure differential in the stream, causing the pressure differential to act on the pressure responsive means to increase the first volume and to decrease correspondingly the second volume and to displace second fluid from the second volume and inject the displaced second fluid via a line into the stream of fluid, wherein the rate of injection of the displaced second fluid into the stream of fluid is modified by an alternate and displacing flow of fluid from the stream set up in the line.

The present invention will now be described, by way of example, with reference to the accompanying drawings, in which.

Figure 1:
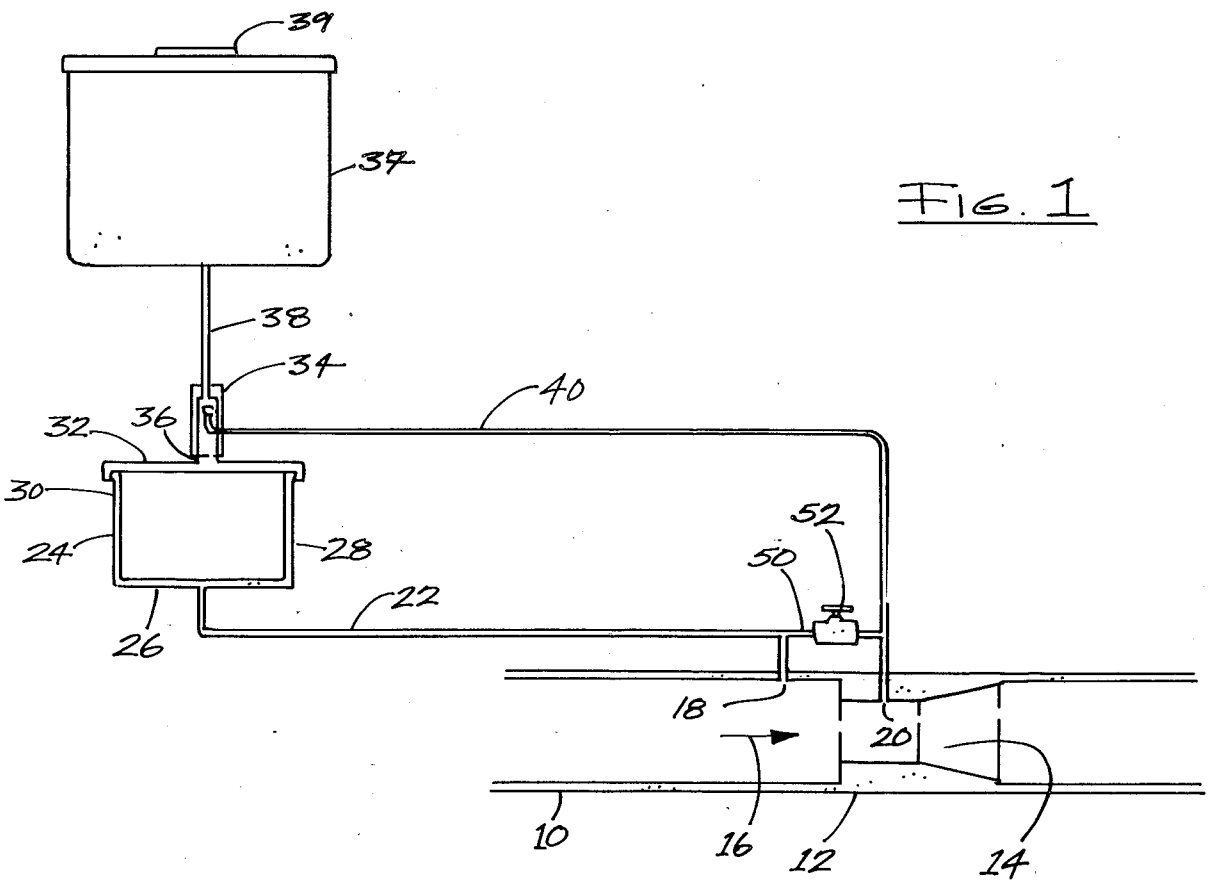
FIG. 1 is a schematic view of a first embodiment of a fluid injection system of the present invention.

In FIG. 1 of the accompanying drawings there is shown a fluid line 10 through which, in use, a fluid flows under pressure. Coupled within the fluid line 10 is a tubular member 12. Each end of the fluid line 10 is connected to the adjacent end of the tubular member 12 by an convenient means.

The tubular member 12 contains a venturi 14 arranged to cause a pressure drop in fluid flowing through the fluid line 10 in the direction shown by the arrow 16. The tubular member 12 also contains two orifices 18 and 20 on the high and low pressure sides of the venturi 14 respectively.

A first conduit 22 extends from the orifice 18 to a pressure tank 24. The pressure tank 24 is of rigid construction.

The pressure tank 24 is bucket shaped having a base 26 with an upstanding peripheral wall 28. The conduit 22 enters the pressure tank 24 through its base 26. Further, the pressure tank 24 also contains a bladder or diaphragm or membrane 30 which is of similar shape to the pressure tank 24 and is thus also bucket shaped. Typically, the bladder 30 has an upper peripheral flange remote from its base. This flange is clamped between an upper outwardly flared end of the peripheral wall 28 of the pressure tank 24 and a lid 32 by any suitable means such as threaded bolts. The bladder 30 has a resilient wall. The bladder 30 may be formed of neoprene or rubber or any flexible material not degraded by the fluids. A first volume is defined by the pressure tank 24 and the bladder 30 and a second volume is defined by the bladder 30 and the lid 32. A shuttle valve 34 is mounted above the lid 32. The shuttle valve 34 communicates with the interior of the pressure tank 24 through a short pipe 36 which passes through the lid 32. Further, the shuttle valve 34 is in communication with a reservoir 37 through a pipe 38 which passes through the underside of the reservoir 37. The reservoir 37 is provided with a breather 39. A metering line 40 also extends from the shuttle valve 34. In use, the shuttle valve 34 performs such that when no bulk fluid is passing through the fluid line 10 fluid passes under gravity from the reservoir 37 through the pipes 38 and 36 to fill up the bladder 30. This causes the bladder 30 to expand and to move outwardly towards the base 26 and wall 28 of the tank 24. Thus, the second volume is increased and the first volume is correspondingly decreased until the bladder 30 is full. When fluid flows through the fluid line 10 and the tubular member 12, a pressure differential is created across the venturi 14. This closes off the supply from the tank 24 and causes fluid from the fluid line 10 to pass through the orifice 18 and the conduit 22 into the pressure tank 24 and exert pressure on the wall of the bladder 30. The bladder 30 moves inwardly causing the second volume to contract as the first volume is increased. Fluid in the bladder 30 is thus expelled through the line 40. The fluid passing through the line 40 enters the tubular member 12 via the orifice 20 and is injected into the stream of the fluid line 10.

It is found over a wide range of flow rates in the fluid line 10 that the rate of injection varies approximately according to the rate of flow. Thus, the amount of second fluid injected per volume of first fluid remains substantially constant. Preferably, the minimum flow rate in the fluid line 10 is sufficient to generate a driving pressure differential that will displace the second fluid. If desired, the tank 24 can be connected in reverse whereby the bladder 30 is in fluid communication with the conduit 22 and the tank 24 is in fluid communication with the conduit 40. In this case, the bladder 30 expands to expell the second fluid from the tank 24. Furthermore, the separator, instead of being in the form of a flexible member, could be in the form of a piston or other member that moves displacing the first and second fluids.

The rate of injection of the second fluid into the first fluid may be varied by means of a by-pass conduit 50 which interconnects the conduit 22 with the line 40.

The presence of the conduit 50 causes the first, bulk fluid to flow from the conduit 22 into the line 40 as an alternative to the flow of the second fluid. This inhibits or proportionately displaces the flow of the second, additive fluid into the venturi.

The by-pass conduit 50 contains an adjustable valve 52. The valve 52 controls the rate of flow of the first, bulk fluid in the conduit 50. As the valve 52 is opened to increase the rate of flow of the first fluid, the rate of flow of the second fluid through the line 40 is decreased and vice versa.

Once the desired rate of addition of the second fluid has been established, this rate of addition will be maintained and the second fluid will flow into the venturi 14 partly pre-mixed with the bulk fluid and will be admixed with the main body of bulk fluid in the desired proportion. The valve 52 may be substituted by a fixed constriction calibrated to a desired rate. The constriction may be a plug partially restricting the by-pass flow. It may also be a multiposition plug for multiple, pre-set rates of flow.

The system may be extended further to incorporate adjustment to the venturi or constriction the purpose of which is to modify the pressure differential (for a given flow rate) and thereby change the range over which the second fluid line and by-pass control the rate of closing. The means of adjusting the venturi could be by mechanical adjustment of a flexible surfaced opening, by sphincter action, or by pumping additional volume of the first fluid into the eye of the venturi. This latter has been found to control the venturi constriction.

The apparatus of FIG. 1 has a wide variety of uses. It may, for example, be used for adding aromatic materials in small volumes as a catalyst to hydrocarbon fuels of low quality to increase the thermal output rating. The apparatus of the present invention provides a safe method of handling highly flammable bulk fluids. The apparatus of FIG. 1 may also be used for metering liquid additives into bulk fluids in gaseous form such as the adding of lubricating oil to compressed air flowing to energise pneumatic tools that require constant lubrication such as pneumatic hammers on drilling machinery.

Figure 2:
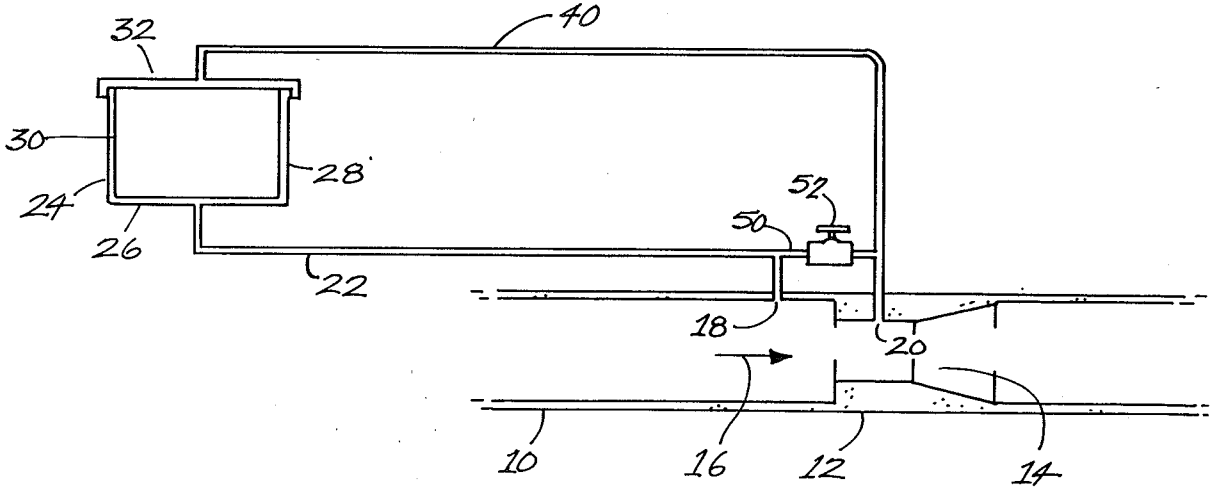
FIG. 2 is a schematic view of a second embodiment of a fluid injection system of the present invention.

The system shown in FIGS. 1 and 2 of the drawings is arranged for operation with fluids in the form of liquids but the present invention can be readily adapted for operation with gases. The system can be extended to have multiple second fluid lines and storage volumes and by-pass controllers feeding a single venturi or multiple venturis in series or parallel.

In FIG. 2 of the accompanying drawings there is shown an apparatus which is a modification of the apparatus of FIG. 1. Like reference numerals are used to denote like parts between FIGS. 1 and 2.

The major difference from the apparatus of FIG. 1 is that the reservoir 37, the pipes 36 and 38 and the shuttle valve 40 are omitted. Further, the metering line 40 leads directly from the bladder 30 through the lid 32 of the tank 24 to the orifice 20.

The apparatus of FIG. 2 operates in essentially the same manner as that of FIG. 1 as described above.

The apparatus of FIG. 2 is envisaged to be a disposable system whereby once all of the second, additive fluid has been expelled from the bladder 30 the entire apparatus will be discarded and replaced by a fresh apparatus in which the bladder 30 is filled with the second additive fluid. The apparatus of FIG. 2 may be used in the same applications as that of FIG. 1. However, because of its disposable characteristics it is useful in other applications. For example, the apparatus of FIG. 2 is particularly envisaged for use with knap sack sprays which are typically used for spraying herbicides or pesticides. With the apparatus of FIGS. 2, the active ingredient to be sprayed would be contained in concentrated form in the bladder 30 and the bulk fluid would be water carried in a portable tank. The bladder 30 could be so designed that the operator need never contact the concentrated active ingredient. Further, the bladder 30 could be incorporated in a cheap disposable assembly including the entire apparatus of FIG. 2 which would be discarded when the bladder 30 was empty.

Figure 3:
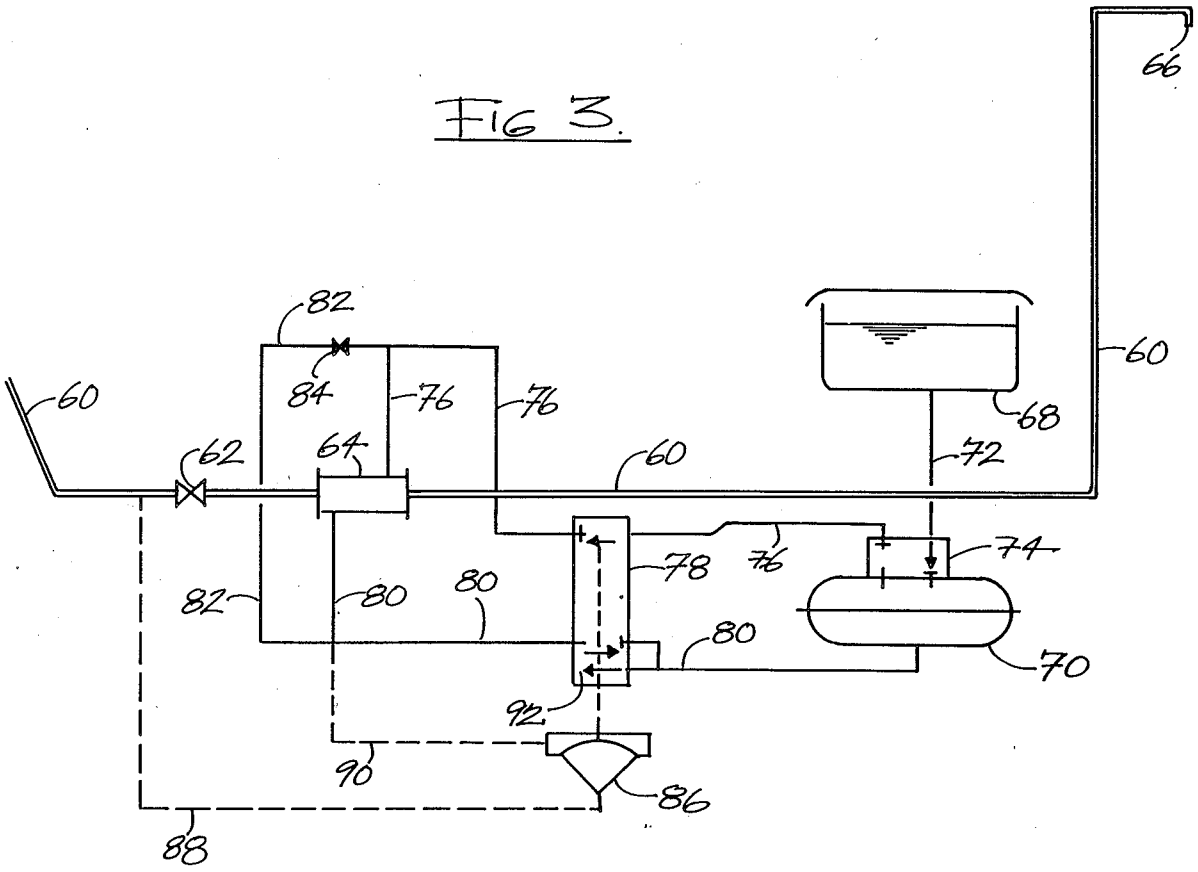
FIG. 3 is a schematic view of an application of the embodiment of FIG. 1.

In FIG. 3 there is shown a variation of the apparatus shown in FIG. 1, for supplying a solution to a stand pipe outlet at a height of, for example, about 3 or 4 meters.

The apparatus shown in FIG. 3 comprises a mains supply waterline 60 which feeds through a main on-off valve 62 to a tubular member 64 which contains a venturi in similar manner to the tubular member 12 of FIG. 1. The mains supply line 60 then continues on horizontally for a distance and then turns through 90° for a distance of about 3 or 4 meters to terminate in a stand pipe outlet 66.

The apparatus of FIG. 3 further comprises a reservoir 68 of concentrate which is typically at a height less than that of the standpipe 66. The apparatus of FIG. 3 further comprises a dosing tank 70 which is similar to the tank 24 of FIG. 1. The dosing tank 70 is arranged to be fed with fresh concentrate via a gravity fed line 72 from the tank 68. The line 72 comprises a shuttle valve 74 similar to the shuttle valve 34 of FIG. 1.

A line 76 leads from the upper end of the tank 70 via the shuttle valve 74 to the upper end of an isolating valve 78 to be described in detail hereinafter. The line 76 then proceeds to a low pressure side of the tubular member 64.

Further, a conduit 80 leads from a high pressure side of the tubular member 64 to the lower end of the isolating valve 78 and then to the lower end of the tank 70. Still further, a metering line 82 branches from the line 80 through a control valve 84 and joins with the line 76. The valve 84 performs the same function as the valve 52 of the apparatus of FIG. 1.

Further, the isolating valve 78 is moved between operating and non-operating positions by means of a diaphragm actuator 86. The diaphragm actuator 86 is connected on one side to the mains line 60 upstream of the valve 62 by means of a line 88 and to the conduit 80 by means of a line 90.

The isolating valve 78 also comprises a drain member 92 at atmospheric pressure.

The apparatus of FIG. 3 operates in similar manner to that of FIG. 1 in that water is fed along the mains line 60 and thus mains pressure is applied along the line 80 to the tank 70. This causes concentrate to be expelled from the tank 70 along the line 76 to the low pressure side of the tubular member 64. The rate of flow of concentrate may be varied by opening or closing the control valve 84.

Figure 4:
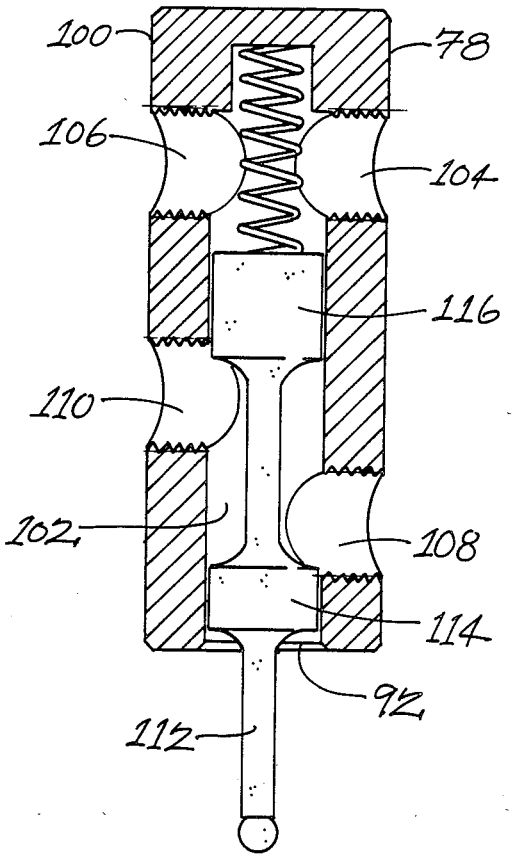
FIG. 4 is a sectional view through an isolating valve of the apparatus of FIG. 3.

Further, the tank 70 can be replenished with concentrate from the reservoir 68 under the influence of gravity through the shuttle valve 74. However, if it is decided to cease supplying liquid to the outlet 66 and the valve 62 is closed then the downstream portion of the line 60 from the valve 62 is filled with water which has a substantial head. Thus, through the line 80 a substantial pressure is still exerted on the tank 70 which prevents replenishment of the concentrate in the tank 70. This problem may be overcome by the isolating valve 78, an embodiment of which is shown in FIG. 4. The valve 78 in FIG. 4 includes a valve body 100 comprising a longitudinally extending cylindrically shaped recess 102. There is also a first port 104 arranged to be connected to the line 76 from the tank 70, a second port 106 arranged to be connected to the line 76 leading to the tubular member 64, a third port 108 is arranged to be connected to the line 80 leading to the tank 70 and a fourth port 110 arranged to be connected to the line 80 leading from the tubular member 64. The recess 102 contains a longitudinally slidable valve spool 112 arranged to be operatively connected to the diaphragm actuator 86. The spool 112 has a first intermediate cylindrical projection 114 and a second endmost cylindrical projection 116.

The upper end of the recess 102 as seen in FIG. 4 is blind and a coil spring is located between the blind end of the recess 102 and the spool 112.

Normally, the spring 102 urges the spool 112 downwardly to the position shown in FIG. 4. In this position the concentrate can flow through the ports 104 and 106 along the line 76. Further, water can flow through the ports 110 and 108 along the line 80 to the tank 70. The projection 116 seals off the ports 104, 106 from the ports 108, 110 whilst the projection 114 seals off the ports 108, 110 from the drain member 92.

However, if the valve 62 is closed there is a higher pressure from the mains upstream of the valve 62 than there is from the elevated outlet 66. Thus, there is a pressure differential between the lines 88 and 90 which causes the diaphragm actuator 86 to lift and raise the valve spool 112. In the raised position the valve spool 112 blocks the ports 104 and 106 by means of the cylindrical projection 116 and cuts off the port 110 from the port 108 by means of the cylindrical projection 114. In this position the tank 70 is isolated from the pressure in the line 60 and the water in the line 80 between the isolating valve 78 and the tank 70 drains away through the port 108 and the drain member 92. This releases pressure on the bladder in the tank 70 and allows the shuttle in the valve 74 to fall so allowing concentrate to flow along the line 72 under the influence of gravity to refill the bladder.

Figure 5:
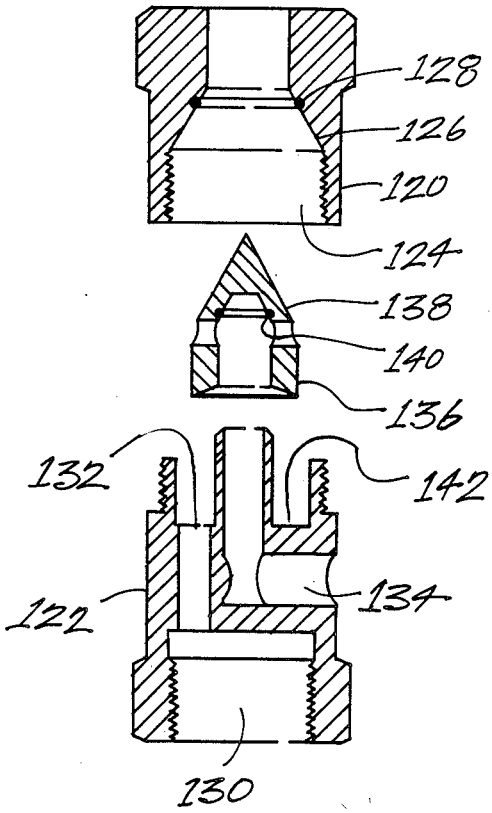
FIG. 5 is a sectional exploded view through a shuttle valve of the apparatus of FIGS. 1 and 3.

A shuttle valve which has been found to be useful in the present invention is shown in FIG. 5. The shuttle valve of FIG. 5 includes an upper part 120 and a lower part 122 which are arranged to be threadedly engaged with one another. The upper part 120 comprises an internal duct 124 comprising an intermediate tapered portion 126 provided with an "O" ring seal 128. The lower part 122 comprises a duct 130 with a narrow upper part 132. Further, the lower part 122 includes adjacent its upper end an L-shaped port 134.

The valve shown in FIG. 5 further comprises a shuttle 136 which comprises a tapered upper portion 138. The tapered upper portion contains an internal "O" ring seal 140. The port 134 is connected to the line 40 in FIG. 1 or the line 76 in FIG. 3. When pressure is applied to the bladder in the tank, fluid pressure is applied through the port 132 so that the fluid from the bladder can be fed to the tubular member containing the venturi. This causes the shuttle 136 to rise until the tapered portions 126 and 138 are engaged with one another and a seal is established by the seal 128. This prevents any fresh concentrate from being fed from the reservoir thereof. However, when the fluid pressure on the bladder is stopped, the shuttle 136 falls under the influence of gravity until it rests on a shoulder 142 adjacent the port 134. In this position the port 134 is sealed by the sealed off 140 and fresh concentrate can flow under the influence of gravity through the ports 124 and 130 into the bladder.

Figure 6:
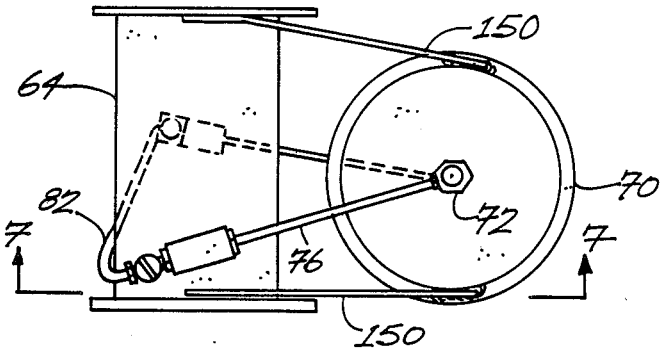
FIG. 6 is a plan view of an apparatus embodying the scheme of FIG. 1.
Figure 7:
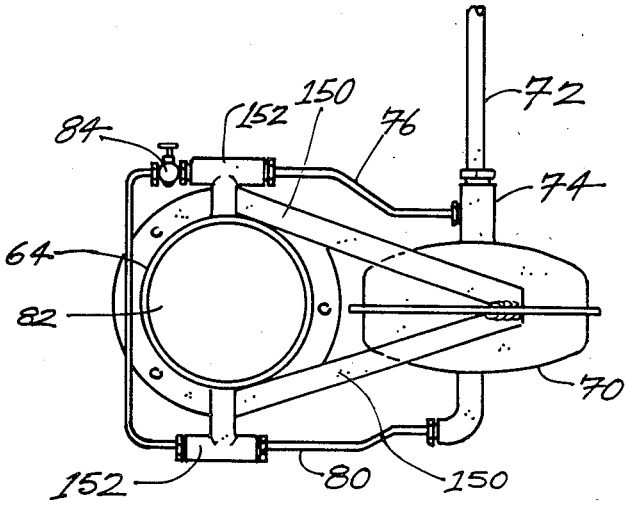
FIG. 7 is a sectional view taken along the line 7—7 of FIG. 6.

In FIGS. 6 and 7 there is shown a particular embodiment of an apparatus constructed in accordance with the scheme of FIG. 3 except that the apparatus contains no isolating valve 78. Like reference numerals denote like parts. In this connection the tubular member 64 is rigidly connected to the tube 70 by a plurality of flat bars 150.

Further, the lines 76, 80 and 82 are connected to the tubular member 64 by means of T-pieces 152. The apparatus shown in FIGS. 6 and 7 is useful as a standpipe insert for enabling water flowing to the standpipe to be dosed at a desired concentration.

Figure 8:
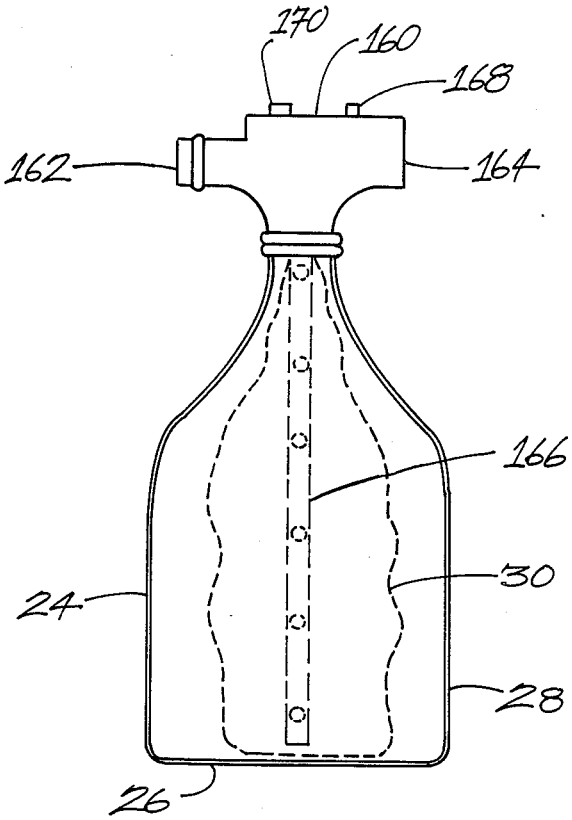
FIG. 8 is a side elevation of an apparatus embodying the scheme of FIG. 2.

In FIG. 8, there is shown a particular embodiment of an apparatus constructed in accordance with FIG. 2. Like reference numerals denote like parts. In FIG. 8 the tank 24 is in the form of a clear plastics bottle and the bladder 30 is in the form of a plastics bag or the like. The bottle is sealed off at the neck by a moulded plastics cap 160. The cap 160 is permanently sealed to the bottle 24.

The cap 160 comprises a male end 162 for fitting to a hand wand (not shown) and a female end 164 for fitting to a hose or knap sack of known type (not shown). An apertured tube 166 depends from the cap 160. The tube 166 ensures that the bag 30 is unfurled in the bottle 24 and also acts as a feed tube in use.

The cap 160 also comprises an on-off cock 168.

The cock 168 must be on and water must be flowing through the cap 160 from the female end to the male end to cause chemicals to be released from the bag 30. The cap 160 also comprises a chemical filler port 170 through which chemical is inserted into the bag 30. After the bag 30 is full the port 170 is permanently sealed. The cap 160 contains all of the components 12, 14, 18, 20, 22, 40, 50 and 52 of FIG. 2.

Thus, when water flows from a hose or knap sack through the cap 160 from the end 164 to the end 162, the concentrate in the bag 30 is expelled into the water at a desired, consistant concentration as determined by the setting of the valve 52. In this embodiment the valve 52 may be permanently set at a particular desired setting. It is also envisaged that in some applications the valve 52 could have, say two positions which could be obtained by a manual switching device.

Figure 9:
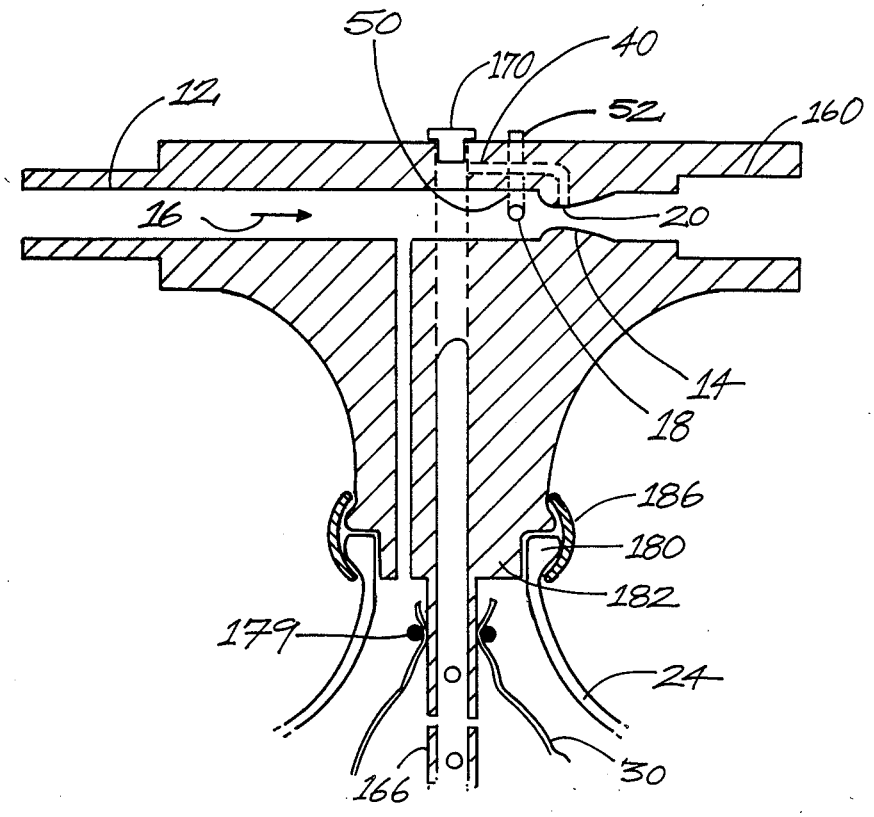
FIG. 9 is a view of a bottle neck sealing arrangement of the apparatus of FIG. 8.

A particular neck construction for the apparatus of FIG. 8 is shown in FIG. 9. In this case the bag 30 is sealed to the tube 166 by means of an "O" ring 179. Further, a neck plug 182 with the tube 166 extending through it, rests on the neck 180 and closes it off and is sealed to the bottle 24.

Figure 10:
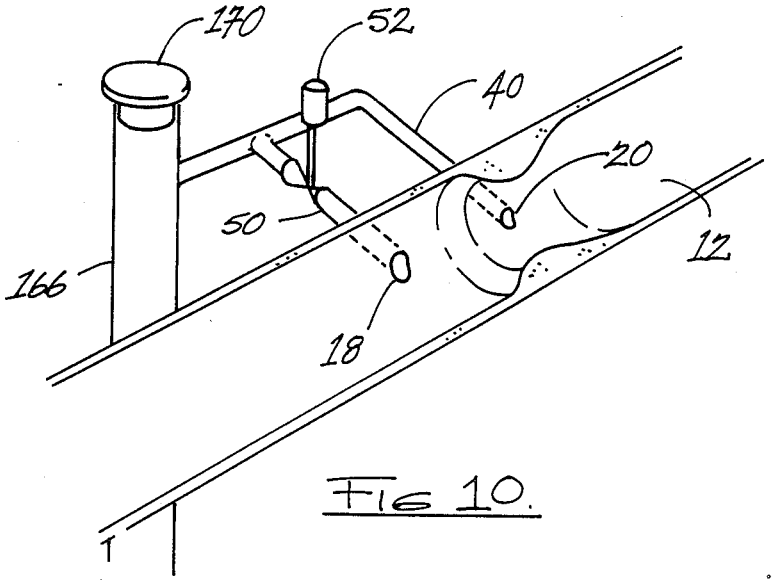
FIG. 10 is an upper perspective view of a part of the apparatus of FIG. 9.
Figure 11:
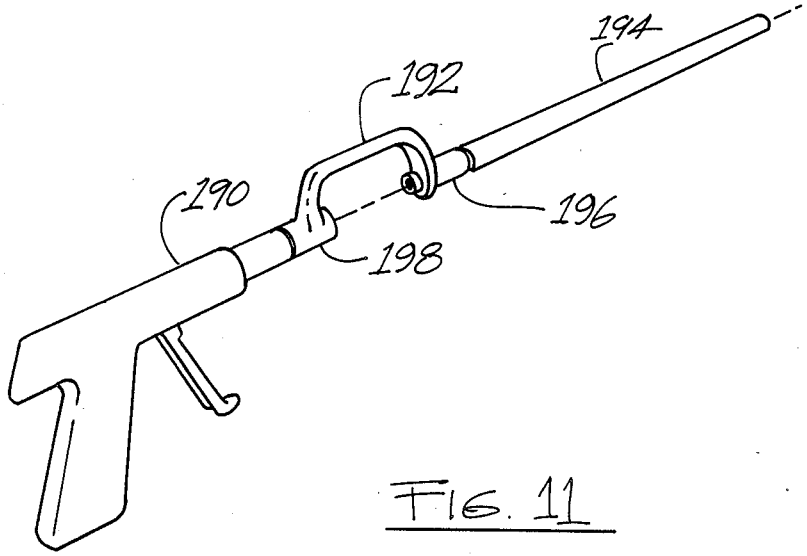
FIG. 11 is a perspective view of a knap sack wand in accordance with the present invention.
Figure 12:
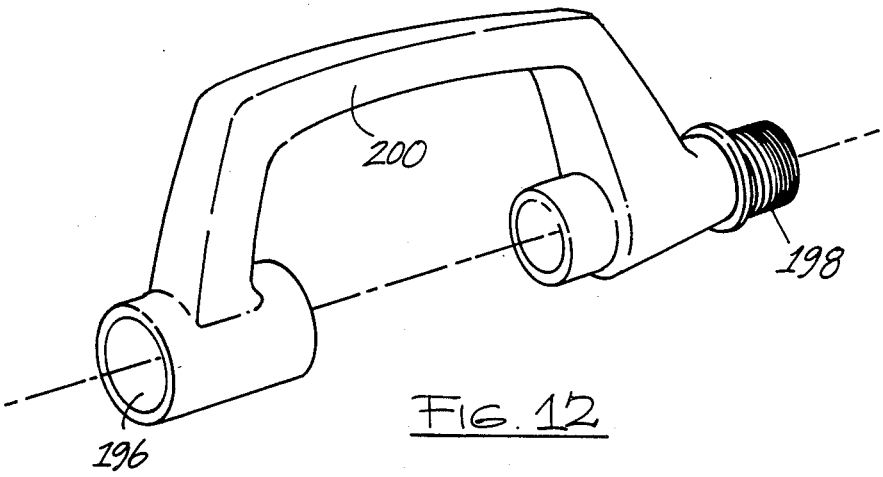
FIG. 12 is a perspective view of an adaptor of the wand of FIG. 10.

A sealing collar 186 is then clamped around the neck 189 and the assembly. The open end of the bag 30 is sealed to the filled tube 166 by means of the "O" ring 179 or other seal so that once the filler port 170 is sealed the concentrate cannot escape except by rupture of the bottle 24. In this connection, the bottle 24 may be made of impact resistant plastics material. Also, the clear nature of the bottle enables a visual observation to be made of the amount of chemical remaining in the bag 30. Also, shown in FIG. 9 is the dosing line 40, the by-pass 50 or the valve 52 which can be seen more clearly in FIG. 10. The by-pass line 50 and the valve 52 serve to displace the cencentrate thereby changing the dose rate from the line 40. The control valve 52 may be replaced by specific plugs that restrict the flow in the by-pass line 50 to a desired rate of control. In FIG. 11, there is shown a knap sack spray head 190 fitted with an adapter 192 which is shown to an enlarged scale in FIG. 12. The spray head 190 comprises a wand 194 into which the adapter 192 is fitted.

The adapter 192 comprises a first internally threaded end tube 196 and a second externally threaded end tube 198. The tubes 196 and 198 are arranged to be fitted to outer and inner ends of the knap sack wand 194 respectively. The tubes 196 and 198 are rigidly interconnected by a bridging member 200 such that under the bridging member 200 there is a gap between the tubes 196 and 198.

Figure 13:
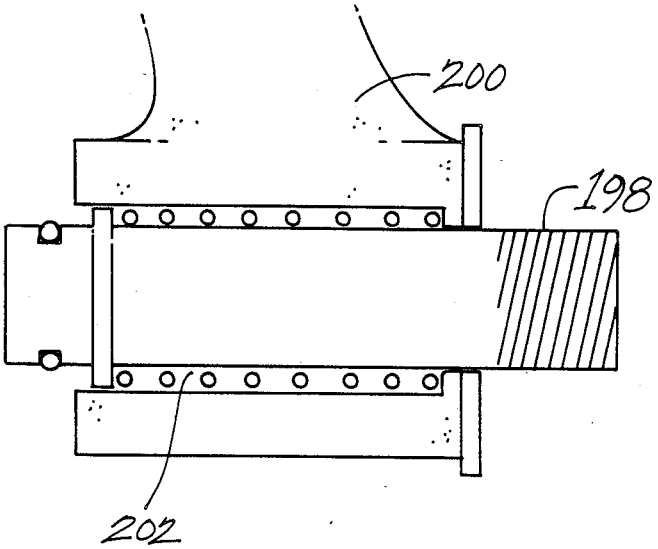
FIG. 13 is a side elevation of part of the adaptor of FIG. 11 showing the spring mounting of a tube member.

Further, as can be seen in FIG. 13, the tube 198 is spring biased by a coil spring 202 to a rest position. The cap 160 of the apparatus of FIG. 9 can be engaged with the tubes 196 and 198 by pressing the tube 198 against the spring 20 to widen the gap between the tubes 196 and 198 and then inserting the cap 160 into the gap. Then the tube 198 can be released so that the tube 198 sealingly engages with the female fitting 164 and the tube 196 sealingly engages with the male fitting 162. In this way, the bottle 24 of FIG. 8 can be readily clipped into a knap sack wand or a hose line and used until the concentrate is exhausted at which time the bottle 24 is removed by the reverse of the procedure described above and replaced by a fresh bottle.

Modifications and variations such as would be apparent to a skilled addressee are deemed within the scope of the present invention. For example, in the embodiment of FIG. 9, with a spring and orifice part, the plug 170 may be used as a "dead-mans-hand". That is, unless the plug 170 is depressed, the plug 170 rises to cut off the flow in the concentrate flow tube 166. Further, venturi could be in the form of an invert venturi in which a solid member is disposed in the center of a pipe or tube to form a constriction.

I claim:

1. A fluid injection system comprising: a tubular member arranged to form part of a fluid line through which, in use, fluid flows under pressure; a venturi contained within the tubular member defining high and low pressure sides thereof; a first chamber defining a first volume and arranged to contain a first fluid; a second chamber disposed substantially within the first chamber defining a second volume and arranged to contain a second fluid; pressure responsive means for separating said first and second volumes, said tubular member on said high pressure side of said venturi being in fluid communication by means of a conduit with said first chamber defining said first volume; a metering line extending from said tubular member on said low pressure side of said venturi and being in fluid communication with said second chamber defining said second volume, a pressure differential being created across said venturi for increasing the first volume by fluid passing from said fluid line into the first volume and by movement of said pressure responsive means said pressure responsive means including a flexible non-degradable bladder, the second volume being correspondingly decreased by fluid passing therefrom through said conduit into the fluid flowing through said fluid line; and a bypass conduit containing valve means provided between the high pressure side of the venturi and said fluid line on said low pressure side of said venturi so as to provide an alternate flow of fluid in said fluid line and modify through volumetric displacement the rate of flow of the second fluid.

2. A fluid injection system according to claim 1, in which the bypass conduit extends between the metering line and the conduit between the high pressure side of the venturi and the means defining the first volume.

3. A fluid injection system according to claim 1, which further comprises a reservoir of the second fluid from which the second volume can be replenished with the second fluid.

4. A fluid injection system according to claim 3, in which the reservoir is connected to the second volume via a supply line containing a shuttle valve which shuttle valve is arranged to close off the supply line when the system is in use and then open the supply line when the system is not in use.

5. A fluid injection system according to claim 3, in which the reservoir is connected to the second volume via a supply line containing a shuttle valve which shuttle valve is arranged to close off the supply line when the system is in use and then open the supply line when the system is not in use and which the reservoir is arranged to replenish the second volume under the influence of gravity and the shuttle valve is arranged to open the supply line under the influence of gravity.

6. A fluid injection system according to claim 3, which is arranged to supply first fluid containing second fluid to an elevated point and which comprises a pressurized fluid supply means for the fluid line, an on-off switch in the supply means upstream of the venturi, an isolating valve arranged to be closed to separate the first and second volumes from the venturi and for sealing off the metering line between the second volume and the isolating valve and the conduit between the venturi and the isolating valve, and a drain member such that the fluid of the first volume can drain away through the drain member when the isolating valve is closed.

7. A fluid injection system according to claim 3, which is arranged to supply first fluid containing second fluid to an elevated point and which comprises a pressurized fluid supply means for the fluid line, an on-off switch in the supply means upstream of the venturi, an isolating valve arranged to be closed to separate the first and second volumes from the venturi and for sealing off the metering line between the second volume and the isolating valve and the conduit between the venturi and the isolating valve, and a drain member such that the fluid of the first volume can drain away through the drain member when the isolating valve is closed, and in which an actuator is provided which is responsive to pressure differential on opposing sides of the fluid line on-off switch to cause opening and closing of the isolating valve.

8. A fluid injection system according to claim 1, which is a disposable sealed apparatus containing no reservoir of second fluid and arranged to be disposed of when empty of second fluid.

9. A fluid injection system according to claim 8, in which the second volume is defined by a bottle and the first volume is defined by a bag in the bottle, the bottle being provided with a closure having fittings arranged to insert the venturi in a fluid line such as a knap sack wand or a hose.

10. A fluid injection system according to claim 1, in which the venturi has an orifice which is of adjustable size.

* * * * *